US010293473B2

(12) United States Patent
Hirai

(10) Patent No.: US 10,293,473 B2
(45) Date of Patent: May 21, 2019

(54) PORTABLE WORKING MACHINE

(71) Applicant: HITACHI KOKI CO., LTD., Tokyo (JP)

(72) Inventor: Takahiro Hirai, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 543 days.

(21) Appl. No.: 14/891,731

(22) PCT Filed: May 28, 2014

(86) PCT No.: PCT/JP2014/064791
§ 371 (c)(1),
(2) Date: Nov. 17, 2015

(87) PCT Pub. No.: WO2014/192964
PCT Pub. Date: Dec. 4, 2014

(65) Prior Publication Data

US 2016/0176037 A1 Jun. 23, 2016

(30) Foreign Application Priority Data

May 28, 2013 (JP) ..... 2013-111895

(51) Int. Cl.
*B25F 5/00* (2006.01)
*B27B 17/00* (2006.01)

(52) U.S. Cl.
CPC ..... *B25F 5/006* (2013.01); *B27B 17/0033* (2013.01)

(58) Field of Classification Search
CPC ..... B25D 17/043; B25D 17/033; B25F 5/02; B25F 5/006
(Continued)

(56) References Cited

U.S. PATENT DOCUMENTS 2,592,649 A * 4/1952 Brackett ..... B21D 39/16 173/170
3,637,029 A * 1/1972 Sherwood, Jr. ..... B27B 17/00 173/162.2
(Continued)

FOREIGN PATENT DOCUMENTS

CN 1644957 A 7/2005
CN 1820901 A 8/2006
(Continued)

OTHER PUBLICATIONS

International Search Report and Written Opinion of the International Search Report for PCT/JP2014/064791 dated Sep. 18, 2014.
(Continued)

*Primary Examiner* — Robert F Long
(74) *Attorney, Agent, or Firm* — Kenealy Vaidya LLP

(57) ABSTRACT

A portable working machine including: a driving source; a main body including the driving source; a handle joined with the main body; a fixing portion provided to one of the main body or the handle; and a vibration-proofing mechanism including an elastic body, the handle joined with the main body with the vibration-proofing mechanism and the fixing portion interposed therebetween; wherein the elastic body of the vibration-proofing mechanism is fixed to a first side of the fixing portion, and a stopper portion configured to come into contact with the other of the main body or the handle to regulate a movement amount of the handle is provided at a second side of the fixing portion, which is opposite to the first side of the fixing portion.

6 Claims, 4 Drawing Sheets

(58) Field of Classification Search
USPC ..... 173/162.1, 210–211, 170
See application file for complete search history.

(56) References Cited

U.S. PATENT DOCUMENTS

| | | | | | |
|---|---|---|---|---|---|
| 3,651,839 | A * | 3/1972 | Stihl | B27B 17/0033 | 173/162.1 |
| 4,138,812 | A * | 2/1979 | Zimmerer | F16F 15/08 | 30/381 |
| 4,141,143 | A * | 2/1979 | Hirschkoff | F16F 3/10 | 30/381 |
| 4,202,096 | A | 5/1980 | Nagashima | | |
| 4,282,938 | A | 8/1981 | Minamidate | | |
| 4,401,167 | A * | 8/1983 | Sekizawa | B25D 17/043 | 173/162.1 |
| 4,478,293 | A * | 10/1984 | Weilenmann | B25D 17/043 | 173/162.2 |
| 4,711,308 | A * | 12/1987 | Blaas | B25D 17/043 | 16/431 |
| 5,025,870 | A * | 6/1991 | Gantner | B25D 17/043 | 173/162.1 |
| 5,361,500 | A | 11/1994 | Naslund et al. | | |
| 5,368,107 | A | 11/1994 | Taomo | | |
| 5,692,574 | A * | 12/1997 | Terada | B25D 17/043 | 173/162.2 |
| 5,697,456 | A * | 12/1997 | Radle | B25D 17/043 | 173/162.2 |
| 5,927,407 | A * | 7/1999 | Gwinn | B25D 17/043 | 173/162.2 |
| 6,076,616 | A * | 6/2000 | Kramp | B25D 17/043 | 173/162.2 |
| 6,100,599 | A * | 8/2000 | Kouchi | F02B 63/04 | 290/1 A |
| 6,148,930 | A * | 11/2000 | Berger | B25D 17/043 | 173/162.2 |
| 6,286,610 | B1 * | 9/2001 | Berger | B25D 17/24 | 173/162.1 |
| 6,863,479 | B2 * | 3/2005 | Frauhammer | B25D 17/043 | 16/426 |
| 7,100,706 | B2 * | 9/2006 | Meixner | B25D 17/043 | 173/162.1 |
| 7,591,325 | B2 * | 9/2009 | Robieu | B25D 17/043 | 173/162.2 |
| 7,819,203 | B2 * | 10/2010 | Sato | B25D 17/11 | 173/128 |
| 7,921,935 | B2 * | 4/2011 | Engelfried | B25D 17/043 | 173/162.2 |
| 7,942,212 | B2 * | 5/2011 | Zimmermann | B27B 17/0033 | 173/162.1 |
| 7,984,618 | B2 * | 7/2011 | Kudo | F25D 19/00 | 324/750.03 |
| 8,225,514 | B2 * | 7/2012 | Guip | B27B 17/0033 | 173/162.2 |
| 8,783,377 | B2 * | 7/2014 | Baumann | B25D 17/24 | 173/1 |
| 9,434,062 | B2 * | 9/2016 | Kamegai | B25D 17/24 | |
| 2006/0179602 | A1 | 8/2006 | Schliemann et al. | | |
| 2006/0219418 | A1 * | 10/2006 | Arakawa | B25D 17/043 | 173/162.2 |
| 2007/0289762 | A1 * | 12/2007 | Kikukchi | B25D 17/043 | 173/162.1 |
| 2008/0276469 | A1 | 11/2008 | Guip et al. | | |
| 2009/0095497 | A1 | 4/2009 | Zimmermann | | |
| 2010/0012339 | A1 * | 1/2010 | Hahn | B25D 17/043 | 173/162.2 |
| 2010/0018734 | A1 * | 1/2010 | Frauhammer | B25D 16/006 | 173/171 |
| 2011/0127056 | A1 * | 6/2011 | Friedrich | B25D 17/043 | 173/162.2 |
| 2012/0031639 | A1 * | 2/2012 | Roberts | B25D 17/043 | 173/162.2 |
| 2012/0160532 | A1 | 6/2012 | Kurzenberger et al. | | |
| 2013/0025897 | A1 * | 1/2013 | Harcar | B25D 17/043 | 173/162.2 |
| 2013/0043052 | A1 * | 2/2013 | Harcar | B25D 17/043 | 173/162.2 |
| 2015/0202760 | A1 * | 7/2015 | Roberts | B25D 17/043 | 173/162.2 |
| 2015/0202761 | A1 * | 7/2015 | Roberts | B25D 17/043 | 173/162.2 |
| 2015/0202762 | A1 * | 7/2015 | Roberts | B25D 17/043 | 173/162.2 |
| 2015/0202764 | A1 * | 7/2015 | Roberts | B25D 17/24 | 173/162.2 |
| 2016/0151905 | A1 * | 6/2016 | Tada | B25D 17/24 | 173/210 |

FOREIGN PATENT DOCUMENTS

| | | | | |
|---|---|---|---|---|
| CN | 101301749 | A | 11/2008 | |
| CN | 101407055 | A | 4/2009 | |
| CN | 102615634 | A | 8/2012 | |
| EP | 2289669 | A1 * | 3/2011 | B25D 17/043 |
| JP | 54-127080 | A | 10/1979 | |
| JP | 58-142331 | U | 9/1983 | |
| JP | 2002-178223 | A | 6/2002 | |
| JP | 2008-106805 | A | 5/2008 | |

OTHER PUBLICATIONS

Japanese Office Action for the related Japanese Patent Application No. 2013-111895 dated Sep. 26, 2016.
Chinese Office Action for the related Chinese Patent Application No. 201480030409.6 dated Jan. 23, 2017.

* cited by examiner

B–B

PORTABLE WORKING MACHINE

This application is a U.S. national phase filing under 35 U.S.C. § 371 of PCT Application No. PCT/JP2014/064791, filed May 28, 2014, and which in turn claims priority under 35 U.S.C. § 119 to Japanese Patent Application No. JP2013-111895, filed May 28, 2013, the entireties of which are incorporated by reference herein.

TECHNICAL FIELD

The present invention relates to a portable working machine having a structure obtained by joining a handle with a main body casing covering a driving source with a vibration-proofing mechanism interposed therebetween.

BACKGROUND ART

As an example of a portable working machine having a structure obtained by joining a handle with a main body casing with a vibration-proofing mechanism interposed therebetween, there is an engine chain saw. The engine chain saw uses an engine (an internal-combustion engine) as a driving source, and a front handle and a rear handle are joined with a main body casing (an engine casing) storing the engine. A user performs tree sawing work while applying a load to the rear handle. Also, in a case where a guide bar for guiding a saw chain is caught in a tree during sawing, it is required to push or pull the rear handle. For this reason, a vibration-proofing mechanism provided between the rear handle and the main body casing having the guide bar fixed thereto needs a structure for regulating a movement amount of the rear handle. Therefore, in a case of installing a spring type vibration-proofing mechanism at the front end portion of the rear handle, in order to regulate the movement amount, a stopper is provided in a spring. However, even if the stopper is provided in the spring, if a large load is applied, the movement amount and inclination of the rear handle may not be appropriately regulated. For this reason, there has been suggested a vibration-proofing device having a separate vibration-proofing mechanism at a position at an opposite side of a fixing portion of the spring (see JP-A-2002-178223, for instance).

PRIOR ART DOCUMENT

Patent Document

[Patent Document 1] JP-A-2002-178223

SUMMARY OF INVENTION

Technical Problem

In a rear-handle attaching structure as disclosed in JP-A-2002-178223, that is, a structure in which a stopper is provided for a spring type first vibration-proofing mechanism, and a second vibration-proofing mechanism for regulating a movement amount and an inclination is provided, in order to effectively regulate vibration, it is required to provide the second vibration-proofing mechanism at the front end portion of the rear handle in line with the first vibration-proofing mechanism. In order to coaxially install the first and second vibration-proofing mechanisms at the front end portion of the rear handle, it is required to dispose the front end of the rear handle at a lower portion of the main body casing capable of providing a seat surface thickness sufficient for fixing the front end of the rear handle and a vibration-proofing material such as a spring or rubber. In this case, since it is possible to place the joint portion of the main body casing and the rear handle inside the main body casing, it is possible to suppress the size of the product from increasing.

The structure according to the related art as described above has the following problems. In an engine chain saw, a layout as disclosed in JP-A-2002-178223 becomes possible if a cylinder is installed in a longitudinal direction. However, in some structures such as a structure in which a cylinder is installed in a transverse direction in order to reduce the size of the product, it may be impossible to provide a sufficient space at a lower portion of the inside of the main body casing. In this case, it is required to install the front end portion of the rear handle at an upper portion of the external appearance of the main body casing. For this reason, a vibration-proofing mechanism to be provided at an upper portion of the main body casing in order to join the rear handle and the main body casing should be joined on the outside of the main body casing. Therefore, if the above described second vibration-proofing mechanism is provided coaxially with the spring type first vibration-proofing mechanism, and a sufficient seat surface thickness capable of allowing the two vibration-proofing mechanisms to be installed is provided, the size of the product inevitably increases.

Accordingly, an object of the present invention is to provide a portable working machine having a configuration capable of effectively regulating a movement amount and inclination of a rear handle without increasing the number of components and the size of the joint portion of a main body casing and the rear handle.

Solution to Problem

Advantageous Effects of Invention

According to an aspect of the present invention, there is provided a portable working machine including: a driving source; a main body including the driving source; a handle joined with the main body; a fixing portion provided to one of the main body or the handle; and a vibration-proofing mechanism including an elastic body, the handle joined with the main body with the vibration-proofing mechanism and the fixing portion interposed therebetween; wherein the elastic body of the vibration-proofing mechanism is fixed to a first side of the fixing portion, and a stopper portion configured to come into contact with the other of the main body or the handle to regulate a movement amount of the handle is provided at a second side of the fixing portion, which is opposite to the first side of the fixing portion.

According to the above-described aspect, it is possible to effectively regulate a movement amount and inclination of the rear handle with a smaller number of components and without increasing the size of the joint portion of the main body casing and the rear handle.

DESCRIPTION OF EMBODIMENT

Figure 1:
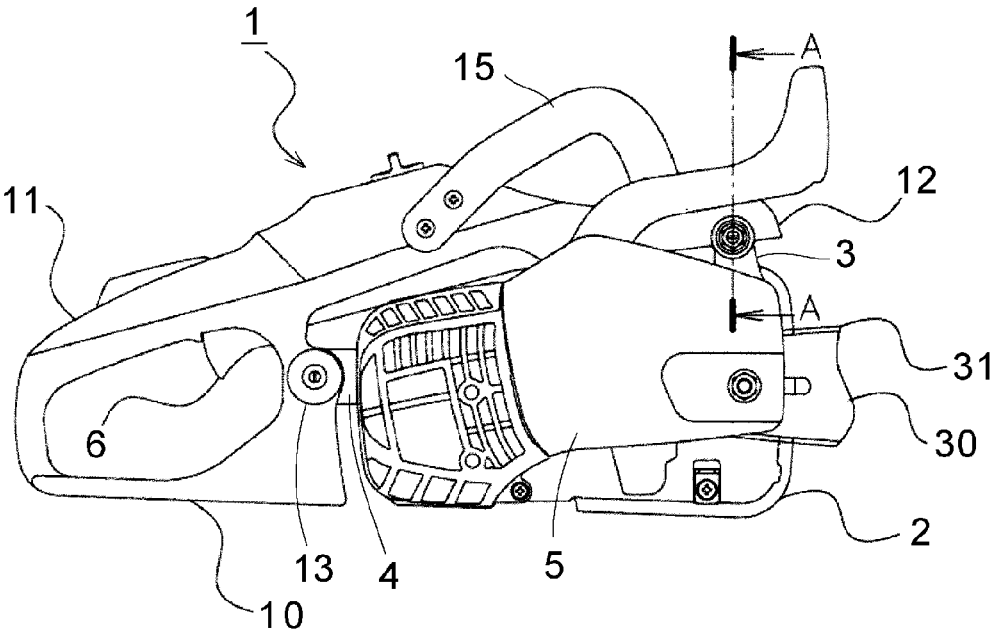
FIG. 1 is a view illustrating an external appearance of a side of an engine chain saw according to a first embodiment of a portable working machine of the present invention.

Hereinafter, embodiments of the present invention will be described in detail with reference to the accompanying drawings. Components, members, processes, and the like shown in the drawings, which are identical or equivalent to each other, are denoted by the same reference symbol, and repetitive explanation thereof will be omitted as necessary. Also, the embodiments do not limit the invention and are illustrative, and all features to be described in the embodiments, and combinations thereof are not necessarily the essential features of the invention.

A portable working machine according to a first embodiment of the present invention will be described taking an engine chain saw as an example. FIG. 1 shows the external appearance of a side of an engine chain saw. An engine chain saw 1 includes an engine (an internal-combustion engine) (not shown) that acts as a driving source, a main body casing (an engine casing) 2 that covers the engine installed in a transverse direction, a rear handle 10 that is attached to the main body casing 2, and a front handle 15 that is attached to the rear handle 10.

In the main body casing 2, a guide bar 30, and a sprocket (not shown) which is rotated by the engine are provided, and a saw chain 31 is stretched over the sprocket and the guide bar 30 so as to run along the guide bar 30 according to rotation of the sprocket. An attaching portion of the sprocket and the guide bar 30 is covered with a side cover 5 fixed to the main body casing 2.

On the main body casing 2, the rear handle 10 is attached from the upper portion of the main body casing 2 to the rear portion of the main body casing 2. The rear handle 10 includes a grip 11 that is positioned at the rear side of the main body casing 2, a front supporting portion 12 that is joined with a fixing rib 3 at the upper side of the main body casing 2 with a vibration-proofing mechanism 20 shown in FIGS. 2 and 3 interposed therebetween, and a rear supporting portion 13 that is joined with fixing ribs 4 at the rear side of the main body casing 2. The fixing ribs 3 and 4 are handle attaching portions formed of a resin or the like integrally with the main body casing 2. Although it will not be described in detail, the engine chain saw has a vibration-proofing structure in which a coil spring, vibration-proofing rubber, or the like is interposed between the rear supporting portion 13 and a corresponding fixing rib 4. The rear supporting portion 13 is provided generally at two positions in a direction perpendicular to the plane of FIG. 1, and is respectively joined with the fixing ribs 4 provided at two positions.

On the grip 11, a throttle 6 is provided. A user can pull the throttle 6 of the grip 11 to adjust the engine chain saw 1 from an idling state to a full speed state. If the engine chain saw 1 reaches a predetermined rotation speed, the saw chain 31 on the periphery of the guide bar 30 moves, and thus the user can cut a tree and so on.

Figure 2:
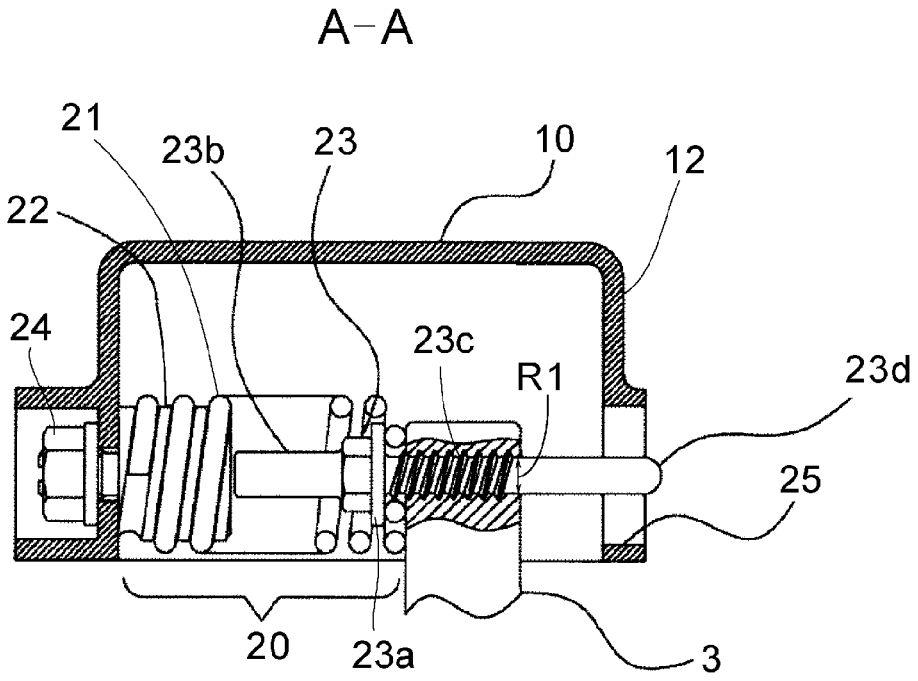
FIG. 2 is a cross-sectional view taken along a line A-A of FIG. 1.
Figure 3:
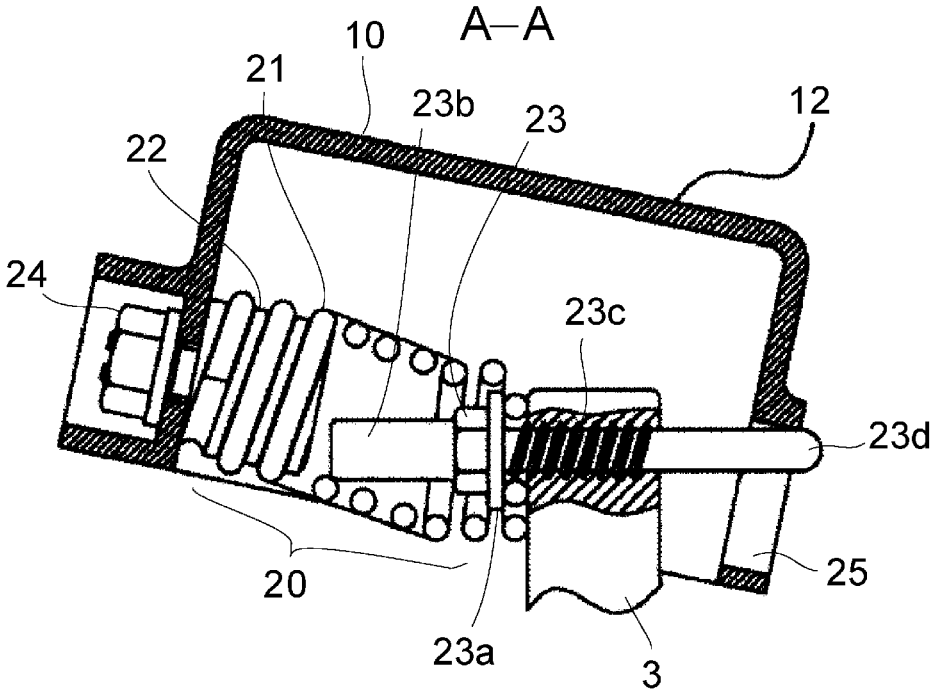
FIG. 3 is a cross-sectional view taken along the line A-A of FIG. 1 and illustrating a state of a handle joining portion of the first embodiment in a case of applying a load to a rear handle.

Subsequently, the joint portion of the main body casing 2 and the front supporting portion 12 of the rear handle 10 will be described with reference to FIGS. 2 and 3. As shown in FIG. 2, a vibration-proofing mechanism 20 includes a coil spring 21 as an elastic body, a holder 22 as an attaching member for attaching one end portion of the coil spring 21 inside the supporting portion 12, and a fixing member 23 for attaching the other end portion of the coil spring 21 on the fixing rib 3 provided at the main body casing side.

The supporting portion 12 of the rear handle 10 has a hollow structure, and one end portion of the coil spring 21 is fixed (fit) to the holder 22, which is fixed to one inner side wall of the supporting portion 12 by a nut 24. The holder 22 has a groove spirally formed at its periphery, and the end portion of the coil spring 21 is fit on the holder 22. The fixing member 23 includes a flange **23*a* formed at an middle portion thereof, a spring stopper portion 23*b* extending at one side of the flange 23*a*, a female screw portion 23*c* formed on the other side of the flange 23*a*, and a regulation stopper portion 23*d* formed at the leading end side. If the fixing member 23 is screwed into the fixing rib 3 provided at the main body casing 2 side, the other end portion of the coil spring 21 is pressed by the flange 23*a*, thereby being fixed to the fixing rib 3. In this case, since the spring stopper portion 23*b* of the fixing member 23 extends inside the coil spring 21, it is possible to regulate a movement amount and inclination of the coil spring 21. The coil spring 21, and the flange 23*a* and the spring stopper portion 23*b* of the fixing member 23 are positioned inside the supporting portion 12**.

Meanwhile, the regulation stopper portion **23*d* of the fixing member 23 penetrates the fixing rib 3 of the main body casing 2, and then penetrates a regulating portion 25 formed as a through-hole, a notch, or the like at the other side wall of the supporting portion 12. According to this configuration, in a case where a load is applied, whereby the rear handle 10 is inclined as shown in FIG. 3, the coil spring 21 and the spring stopper portion 23*b* come into contact with each other, and the inner edge of the regulating portion 25 of the supporting portion 12 and the regulation stopper portion 23*d* come into contact with each other. As a result, the movement amount and inclination of the rear handle 10 is regulated. That is, in the present embodiment, the coil spring 21 of the vibration-proofing mechanism 20 is fixed to a first side of the fixing rib 3 of the main body casing 2, and the regulation stopper portion 23*d* that comes into contact with the rear handle 10 to regulate the movement amount of the rear handle 10 is provided at a second side of the fixing rib 3, which is opposite to the first side of the fixing rib 3**.

Also, since the regulation stopper portion **23*d* of the fixing member 23 that penetrates the fixing rib 3 of the main body casing 2 is formed to have an outer diameter smaller than the diameter R1 of a hole formed in the fixing rib 3, even if the regulation stopper portion 23*d* does not have a female screw portion, it is possible to penetrate the regulation stopper portion 23*d* through the fixing rib 3. Therefore, it is possible to smoothly regulate the inclination of the rear handle 10**.

Also, the regulation stopper portion **23*d* is configured to regulate the movement amount of the handle by coming into contact with the inner edge of the regulating portion 25 at the rear handle side, when a load, which is three times or larger than a total weight of the portable working machine, is applied to the stopper portion 23*d***.

According to the present embodiment, it is possible to achieve the following effects.

(1) In the configuration including the rear handle 10 joined with the main body casing 2 with the vibration-proofing mechanism 20 interposed therebetween, the fixing member 23 for fixing the coil spring 21, which is a vibration-proofing material of the vibration-proofing mechanism 20, to the main body casing 2 penetrates the fixing rib 3 of the main body casing 2, and the leading end portion of the penetrated fixing member 23 becomes the stopper portion 23*d* for regulating the movement amount and inclination of the rear handle 10. Since the member for fixing the coil spring 21 and the stopper portion are composed of the same member, it is possible to reduce the number of components.

(2) Since the member for fixing the coil spring 21 as a vibration-proofing material and the stopper portion are composed of the same member, that is, the fixing member 23, as compared to a case of separately providing a spring fixing member and a stopper member at both sides of the fixing rib 3, respectively, it is possible to reduce the thickness of the fixing rib 3 having a seat surface for fixing the coil spring 21, and it is possible to reduce the price and size of the product.

(3) Since the spring stopper portion 23*b* and the female screw portion 23*c* of the fixing member 23, and the regulation stopper portion 23*d* provided at the leading end side of the fixing member 23 are provided coaxially, it becomes easy to attach the fixing member 23 to the fixing rib 3, and it is possible to reduce the size of the joint portion of the main body casing 2 and the rear handle 10.

(4) Since the outer diameter of the regulation stopper portion 23*d* of the fixing member 23 is smaller than the diameter R1 of the hole formed in the fixing rib 3, even if the regulation stopper portion 23*d* does not have a female screw portion, it is possible to penetrate the fixing member 23 through the fixing rib 3. Therefore, the surface of the regulation stopper portion 23*d* can be made smooth, and it is possible to smoothly regulate the inclination of the rear handle 10.

Figure 4:
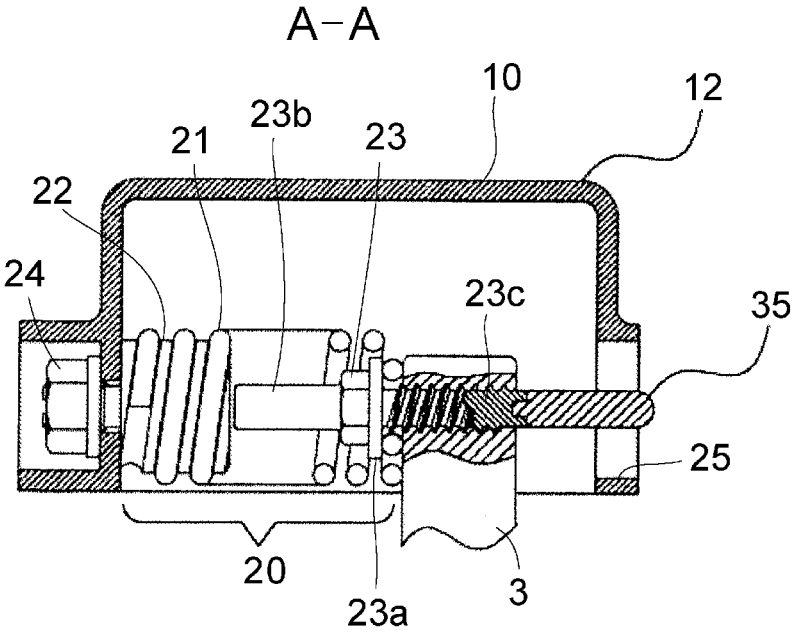
FIG. 4 is a cross-sectional view of a second embodiment of the present invention taken along the line A-A of FIG. 1.

FIG. 4 is a cross-sectional view taken along a line A-A of FIG. 1 and illustrating a second embodiment of the present invention. Here, a separate regulation stopper portion 35 is integrally joined with the leading end side of the female screw portion 23*c* of the fixing member 23. The regulation stopper portion 35 is provided coaxially with the spring stopper portion 23*b* and female screw portion 23*c* of the fixing member 23, and has an outer diameter smaller than the diameter of the hole formed in the fixing rib 3. The other configuration is the same as that of the above described first embodiment, and the effects are also the same as those of the first embodiment.

Figure 5:
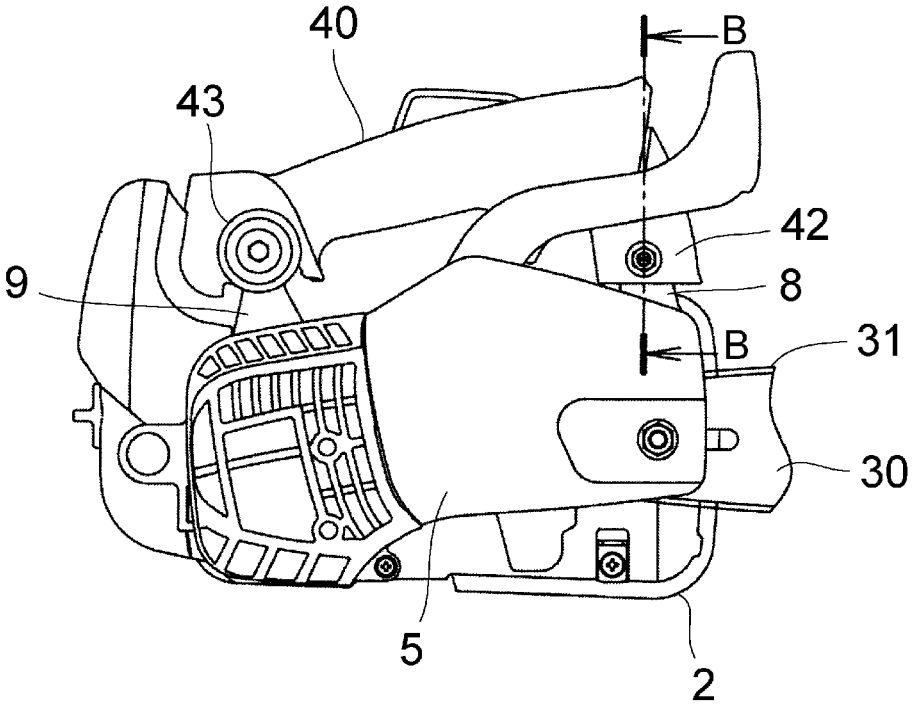
FIG. 5 is a view illustrating an external appearance of a side of a top handle type engine chain saw according to a third embodiment of the present invention.
Figure 6:
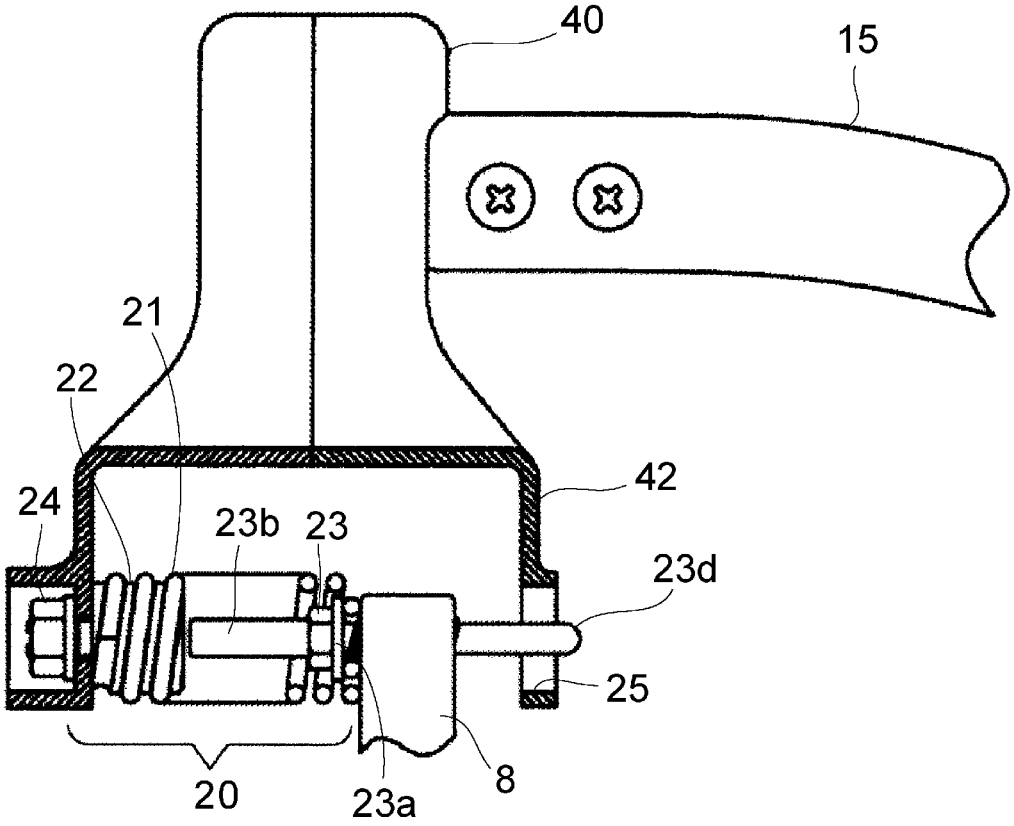
FIG. 6 is a cross-sectional view taken along a line B-B of FIG. 5.

FIG. 5 is a view illustrating the external appearance of a side of a top handle type engine chain saw according to a third embodiment of the present invention. FIG. 6 is a cross-sectional view taken along a line B-B of FIG. 5. In this case, on the main body casing 2, a top handle 40 is installed to extend from the front side to the rear side of the upper side of the main body casing 2. The top handle 40 includes a front supporting portion 42 that is joined with a fixing rib 8 at the upper side of the main body casing 2 with a vibration-proofing mechanism 20 shown in FIG. 6 interposed therebetween, and a rear supporting portion 43 that is joined with a fixing rib 9 at the rear side of the main body casing 2. The fixing ribs 8 and 9 are handle attaching portions formed of a resin or the like integrally with the main body casing 2. Although it will not be described in detail, the engine chain saw has a vibration-proofing structure in which a coil spring, vibration-proofing rubber, or the like is interposed between the rear supporting portion 43 and the fixing rib 9. The rear supporting portion 43 is provided generally at one position in a direction perpendicular to the plane of FIG. 5, and is joined with the fixing rib 9 provided at one position.

The configuration of the joint portion of the supporting portion 42 and the fixing rib 8 of the main body casing 2 side shown in FIG. 6 is the same as that of the first embodiment, and portions identical or corresponding to those of the first embodiment are denoted by the same reference symbols. Also, the front portion of the top handle 40 is joined with the front handle 15.

The third embodiment also have the same structure as that of the first embodiment except that the attaching position of the top handle 40 is the upper side of the main body casing 2, and have the same effects as those of the first embodiment.

Although the invention has been described with reference to the embodiments, it can be understood by those skilled in the art that a variety of modifications can be applied to the components and processes of the embodiments without departing from the scope of the claims. Hereinafter, modifications will be described.

In the first to third embodiments of the present invention, as the vibration-proofing material (elastic body) of the vibration-proofing mechanism 20, the coil spring 21 has been exemplified. However, it is possible to use any other elastic body such as vibration-proofing rubber. Also, it is possible to dispose an elastic body around the stopper portion or on the inner periphery of the regulating portion. In this case, even during regulating of the movement amount of the handle, it is possible to obtain a vibration-proofing effect.

Further, in the first to third embodiments of the present invention, the fixing rib is provided to the main body casing, and the coil spring of the vibration-proofing mechanism is fixed to a first side of the fixing rib of the main body casing, and the regulation stopper portion that comes into contact with the handle to regulate the movement amount of the handle is provided at a second side of the fixing rib of the main body casing, which is opposite to the first side of the fixing rib. However, the invention is not limited thereto, and the fixing rib can be provided to the handle, and the coil spring of the vibration-proofing mechanism can be fixed to a first side of the fixing rib of the handle, and the regulation stopper portion that comes into contact with the main body to regulate the movement amount of the handle can be provided at a second side of the fixing rib of the handle, which is opposite to the first side of the fixing rib. Further, in the first to third embodiments of the present invention, the fixing rib was employed as an example of the fixing portion. However, the fixing portion is not limited to a fixing rib.

Although the present invention has been described taking an engine chain saw as an example, the present invention can be applied to electrically-operated chain saws, and can also be applied to any other portable working machines each having a mechanism for moving a blade back and forth.

The present invention provides illustrative, non-limiting aspects as follows:

(1) In a first aspect, there is provided a portable working machine including: a driving source; a main body including the driving source; a handle joined with the main body; a fixing portion provided to one of the main body or the handle; and a vibration-proofing mechanism including an elastic body, the handle joined with the main body with the vibration-proofing mechanism and the fixing portion interposed therebetween; wherein the elastic body of the vibration-proofing mechanism is fixed to a first side of the fixing portion, and a stopper portion configured to come into contact with the other of the main body or the handle to regulate a movement amount of the handle is provided at a second side of the fixing portion, which is opposite to the first side of the fixing portion.

(2) In a second aspect, there is provided the portable working machine according to the first aspect, further including a fixing member, wherein the fixing member penetrates the fixing portion, and a portion of the fixing member protruding toward the second side of the fixing portion configures the stopper portion.

(3) In a third aspect, there is provided the portable working machine according to the second aspect, wherein the stopper portion of the fixing member and a portion of the fixing member other than the stopper portion are provided coaxially.

(4) In a fourth aspect, there is provided the portable working machine according to the second or third aspect, wherein an outer diameter of the stopper portion is smaller than a diameter of a hole formed in the fixing portion.

(5) In a fifth aspect, there is provided the portable working machine according to any one of the first to fourth aspects, wherein, when a load, which is three times or larger than a total weight of the portable working machine, is applied to the vibration-proofing mechanism, the handle and the stopper portion comes in contact with each other so that the stopper portion regulates the movement amount of the handle.

(6) In a sixth aspect, there is provided the portable working machine according to any one of the first to fifth aspects, wherein the handle includes a supporting portion, and wherein the elastic body is disposed inside the supporting portion, and one end of the elastic body is fixed to the fixing portion of the main body by the fixing member, and an other end of the elastic body is fixed to the supporting portion of the handle by an attaching member.

(7) In a seventh aspect, there is provided the portable working machine according to the sixth aspect, wherein the supporting portion of the handle includes a regulating portion, the stopper portion penetrates the regulating portion, and the stopper portion and an inner edge of the regulating portion is configured to come into contact with each other to regulate the movement amount of the handle.

Arbitrary combinations of the above described components of the aspects, and modifications obtained by conversion of the present invention into methods and systems are also valid as aspects of the present invention.

This application claims priority from Japanese Patent Application No. 2013-111895 filed on May 28, 2013, the entire content of which is incorporated herein by reference.

INDUSTRIAL APPLICABILITY

According to an aspect of the invention, there is provided a portable working machine having a configuration capable of effectively regulating a movement amount and inclination of a rear handle without increasing the number of components and the size of the joint portion of a main body casing and the rear handle.

What is claimed is:

1. A portable working machine comprising:

a driving source;

a main body including the driving source;

a handle joined with the main body;

a fixing portion which is a protruding portion and being provided to one of the main body or the handle;

a vibration-proofing mechanism including an elastic body, the handle joined with the main body with the vibration-proofing mechanism and the fixing portion interposed therebetween;

a fixing member; and a regulating portion provided to another of the main body or the handle;

wherein one longitudinal direction end of the elastic body of the vibration-proofing mechanism is fixed to a first side of the fixing portion by the fixing member, another longitudinal direction end of the elastic body of the vibration-proofing mechanism is fixed to the other of the main body or the handle, and a stopper portion configured to come into contact with the other of the main body or the handle to regulate a movement amount of the handle is provided at a second side of the fixing portion opposite to the first side of the fixing portion, wherein the fixing member penetrates the fixing portion, and a portion of the fixing member protruding toward the second side of the fixing portion configures the stopper portion, and wherein the stopper portion penetrates the regulating portion, and the stopper portion and an inner edge of the regulating portion is configured to conic into contact with each other to regulate the movement amount of the handle.

2. The portable working machine according to claim 1, wherein the stopper portion of the fixing member and a portion of the fixing member other than the stopper portion are provided coaxially.

3. The portable working machine according to claim 1, wherein an outer diameter of the stopper portion is smaller than a diameter of a hole formed in the fixing portion.

4. The portable working machine according to claim 1, wherein, when a load, which is three times or larger than a total weight of the portable working machine, is applied to the vibration-proofing mechanism, the handle and the stopper portion comes in contact with each other so that the stopper portion regulates the movement amount of the handle.

5. The portable working machine according to claim 1, wherein the handle includes a supporting portion, and wherein the elastic body is disposed inside the supporting portion, and one end of the elastic body is fixed to the fixing portion of the main body by the fixing member, and another end of the elastic body is fixed to the supporting portion of the handle by an attaching member.

6. A portable working machine comprising:

a driving source;

a main body including the driving source;

a vibration-proofing mechanism including an elastic body;

a handle joined with the main body with the elastic body interposed therebetween;

a fixing portion which is a protruding portion and being provided to one of the main body or the handle;

a fixing member fixing the elastic body to a first side of the fixing portion; and a regulating portion provided to another of the main body or the handle;

wherein the fixing member penetrates the fixing portion and the regulating portion, and wherein the fixing member and an inner edge of the regulating portion is configured to come into contact with each other to regulate the movement amount of the handle at a second side of the fixing portion opposite to the first side of the fixing portion.

* * * * *